US009347698B2

(12) United States Patent
Kana

(10) Patent No.: US 9,347,698 B2
(45) Date of Patent: May 24, 2016

(54) SYSTEM AND METHOD FOR CREATING A GLASS WITH AN ICE LINING

(71) Applicant: Daniel Kana, Beford, NH (US)

(72) Inventor: Daniel Kana, Beford, NH (US)

( * ) Notice: Subject to any disclaimer, the term of this patent is extended or adjusted under 35 U.S.C. 154(b) by 366 days.

(21) Appl. No.: 14/048,373

(22) Filed: Oct. 8, 2013

(65) Prior Publication Data

US 2014/0102118 A1 Apr. 17, 2014

Related U.S. Application Data

(60) Provisional application No. 61/711,854, filed on Oct. 10, 2012.

(51) Int. Cl.
*F25C 1/00* (2006.01)
*A47G 19/22* (2006.01)
*F25C 1/22* (2006.01)

(52) U.S. Cl.
CPC ..... *F25C 1/00* (2013.01); *A47G 19/2288* (2013.01); *F25C 1/22* (2013.01); *F25D 2331/808* (2013.01)

(58) Field of Classification Search
CPC ..... F25C 1/22; F25C 1/225; F25C 1/02; F25C 1/04; A47G 19/228; A47G 19/22; F25D 2303/084; F25D 2303/0841; F25D 2303/0842
See application file for complete search history.

(56) References Cited

U.S. PATENT DOCUMENTS 2,961,849 A * 11/1960 Hitchcock ..... F25C 1/24 215/12.1
7,124,603 B2 10/2006 Bianco
2009/0242732 A1* 10/2009 Garmizo ..... A47G 19/2288 249/204
2011/0005401 A1* 1/2011 Burroughs ..... A47G 19/2205 99/323.1

FOREIGN PATENT DOCUMENTS

CN 2802392 Y 8/2006

* cited by examiner

*Primary Examiner* — Jonathan Bradford
*Assistant Examiner* — Elizabeth Martin

(57) ABSTRACT

An ice mold configured to be placed into a glass or cup such that a side wall void is created between the outer wall of the ice mold and the interior wall of the glass or cup. The exterior shape of the ice mold generally mirrors the interior shape of the cup or glass. Liquid such as water or juice is placed into the glass or cup after the ice mold is inserted, thereby forcing the liquid into the side wall void, following which the combination of the ice mold and glass or cup are frozen. Once the liquid freezes, the ice mold is then removed leaving an ice wall on the interior wall of the glass or cup. The ice mold may feature one or more attachment mechanisms or an outer rim in order to secure the mold to an upper rim of the glass or cup.

9 Claims, 6 Drawing Sheets

SYSTEM AND METHOD FOR CREATING A GLASS WITH AN ICE LINING

CROSS-REFERENCE TO RELATED APPLICATIONS

This application claims priority from U.S. Provisional Patent Application No. 61/711,854 entitled "System and Method for Creating a glass with an Ice Lining", filed on Oct. 10, 2012 which is incorporated fully herein by reference.

TECHNICAL FIELD

The present invention relates to a cooling device for a drinking apparatus and more particularly, relates to an apparatus designed to form an ice wall on the inner surface of a drinking glass.

BACKGROUND INFORMATION

Many attempts have been made to keep drinks and cocktails cold in various cups and glasses. All of these prior art designs suffer from one or more flaws. The goal has been to maintain the drink at a cold temperature for the longest amount of time, while also not watering down the drink. Some of the prior art designs contain water or another freezable liquid in the walls of a drinking apparatus, which is then placed into a freezer and frozen. Although this design prevents the drink from watering down as the ice melts, it does require that the drinking glass be made from an acrylic or similar plastic material, so that the glass does not break in the freezer. Many consumers prefer to drink from real glass rather than drinking from a thick rimmed plastic glass. Other designs create a large ice ball that sits in the middle of the drink, but which is not suitable for many styles of drinks, such as for use with a martini glass. Therefore, what is needed is a method of forming an ice liner around the inner walls of a drinking apparatus, which can be used with real glass and which is simple to use.

SUMMARY

The invention features a method for creating an ice wall lining in a drinking glass and an ice mold utilized for creating such an ice lining. The method comprises the acts of: placing a drink mold into the drinking apparatus, wherein the drink mold comprises: a body portion with an outer wall, the outer wall configured to mimic a shape of the interior wall of the drinking apparatus; wherein the placement of the drink mold into the drinking apparatus creates a side wall void between the outer wall of the drink mold and the interior wall of the drinking apparatus, wherein the side wall void is configured to contain the water or other fluid; adding water or other liquid into the drinking apparatus through an opening in the top region of the ice mold, the water filling a gap formed between the ice mold and an interior wall of the drinking apparatus; placing the drinking apparatus with the drink mold into a freezer until the water freezes; and removing the drink mold from the drinking apparatus, wherein the interior wall of the drinking apparatus maintains an ice wall.

In the preferred embodiment, the ice mold includes an outer rim coupled to the top region of the ice mold, the outer rim configured, in use, for abutting against the rim of the drinking apparatus. In another embodiment, the outer rim includes a groove or slot configured for frictionally fitting on the rim of the drinking apparatus.

The ice mold is preferably manufactured from a generally soft, pliable food grade material such as silicone, while the drinking apparatus is preferably but without limitation selected from the group of drinking apparatus consisting of a martini glass and a rocks glass.

It is important to note that the present invention is not intended to be limited to a system or method which must satisfy one or more of any stated objects or features of the invention. It is also important to note that the present invention is not limited to the preferred, exemplary, or primary embodiment(s) described herein. Modifications and substitutions by one of ordinary skill in the art are considered to be within the scope of the present invention.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

An ice mold or ice forming apparatus 10, FIGS. 1-10, in accordance with the present invention is designed to create an ice liner on and around the interior surface of a drinking apparatus, cup or glass 22. Although the invention is primarily described in use first with a martini glass and secondly with a rocks glass, it is contemplated and within the scope of the present invention that the invention could be used with a cocktail glass, or any other drinking apparatus, glass or cup.

The ice mold 10 is configured to mimic or mirror the interior shape and size of the drinking apparatus 22. For example, when used with a martini glass, the ice mold 10 will exhibit a generally conical shape (see FIGS. 1-5) while when designed for use with a rocks glass, the ice mold 10 will exhibit a generally rectangular shape (see FIGS. 6-8).

Figure 1:
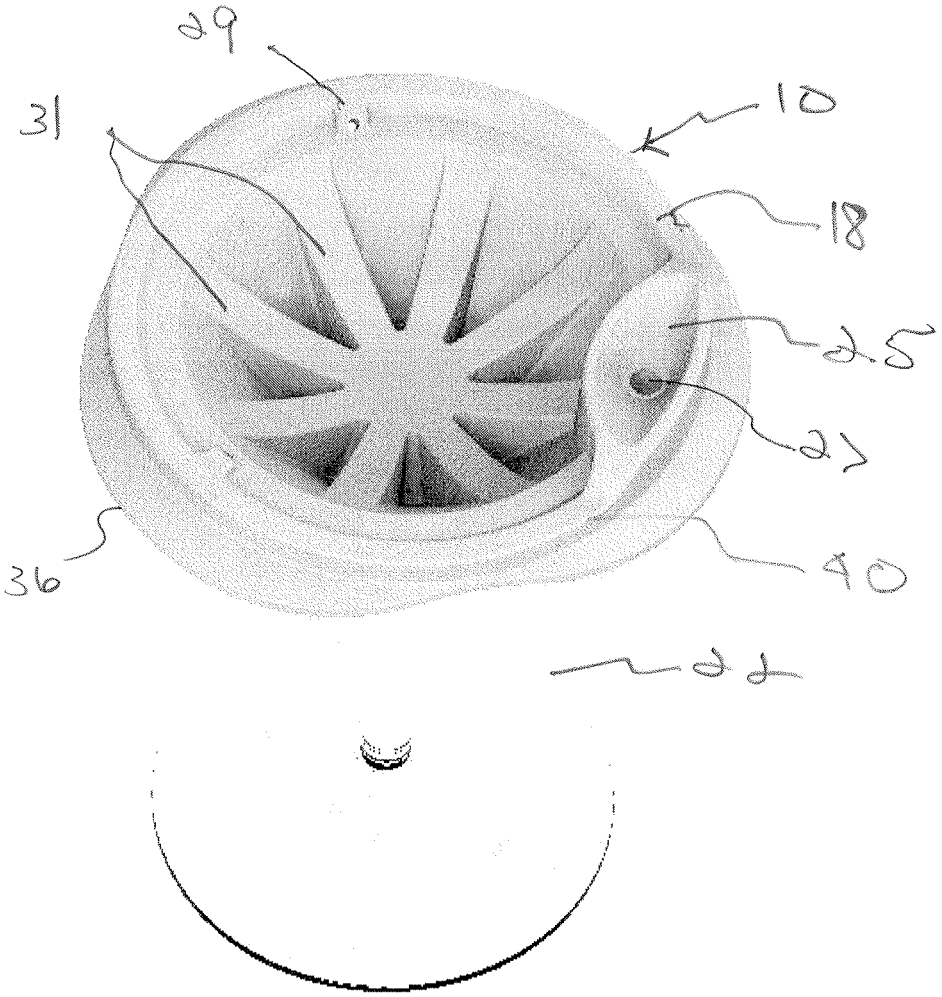
FIG. 1 is a perspective view of the ice forming apparatus according to one embodiment of the present invention when used with a martini glass according to a first embodiment of the present invention.
Figure 2:
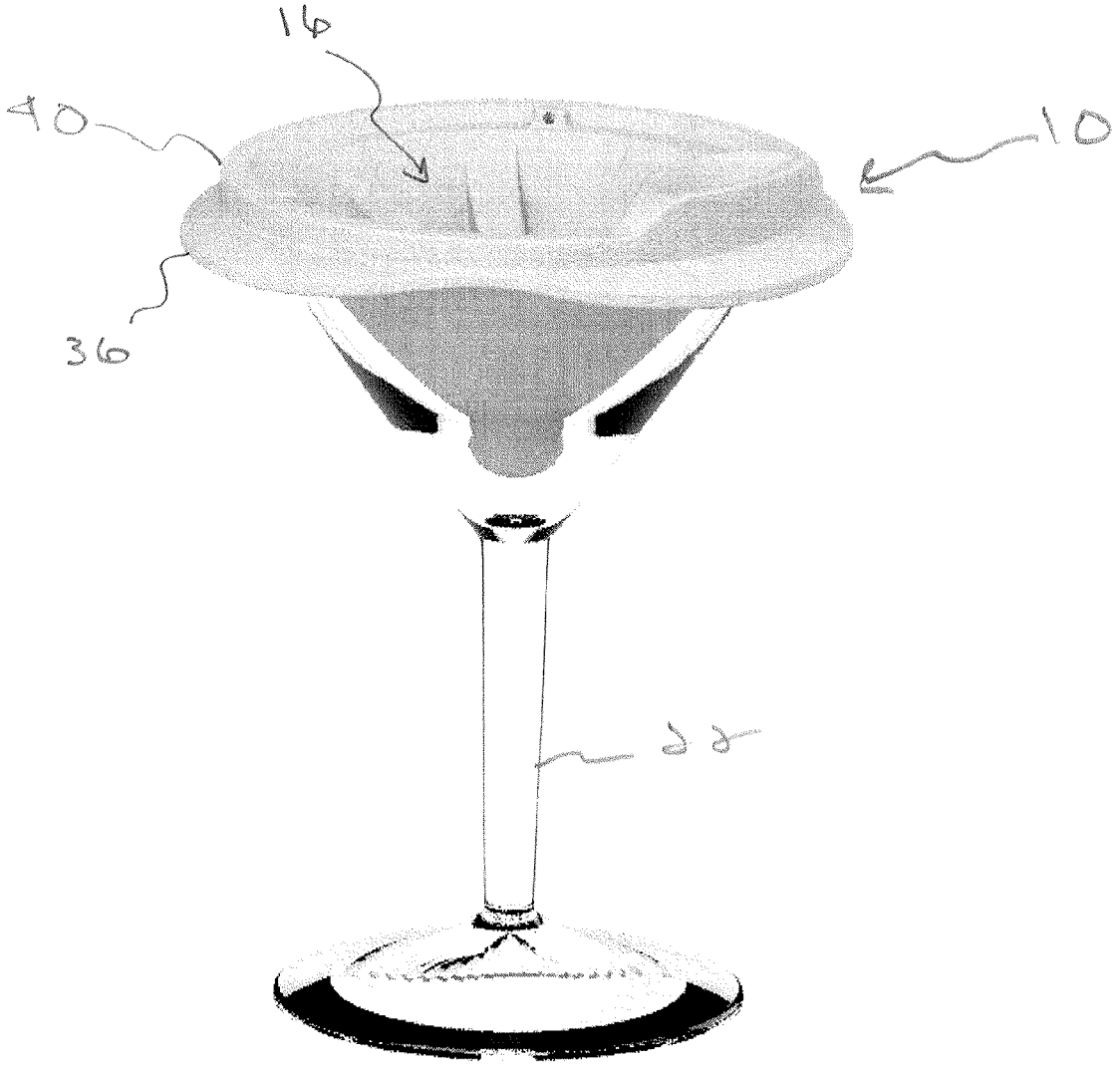
FIG. 2 is a front view of the ice forming apparatus according to the first embodiment of the present invention.
Figure 3:
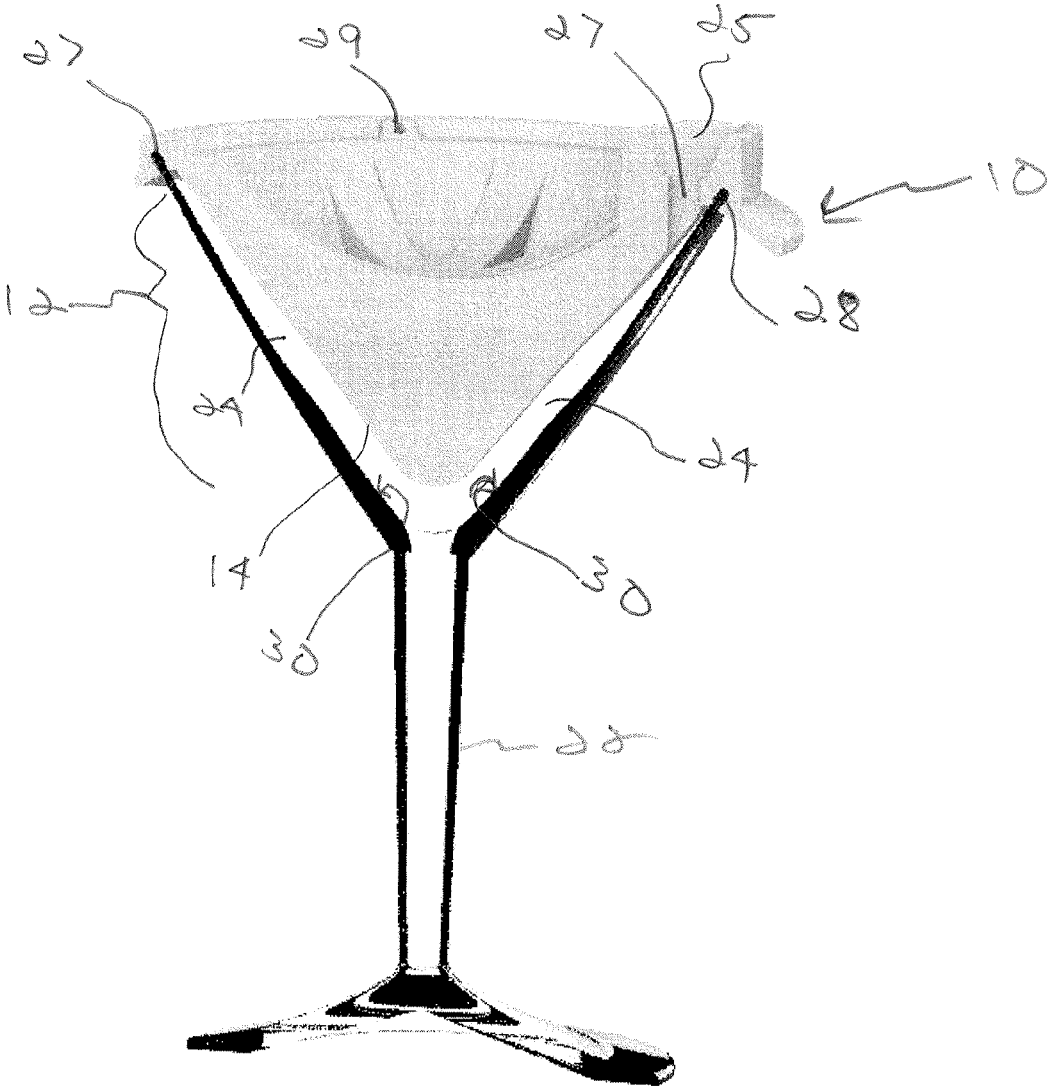
FIG. 3-5 are cross-sectional views of the ice forming apparatus of FIG. 1 in accordance with the first embodiment of the present invention.
Figure 4:
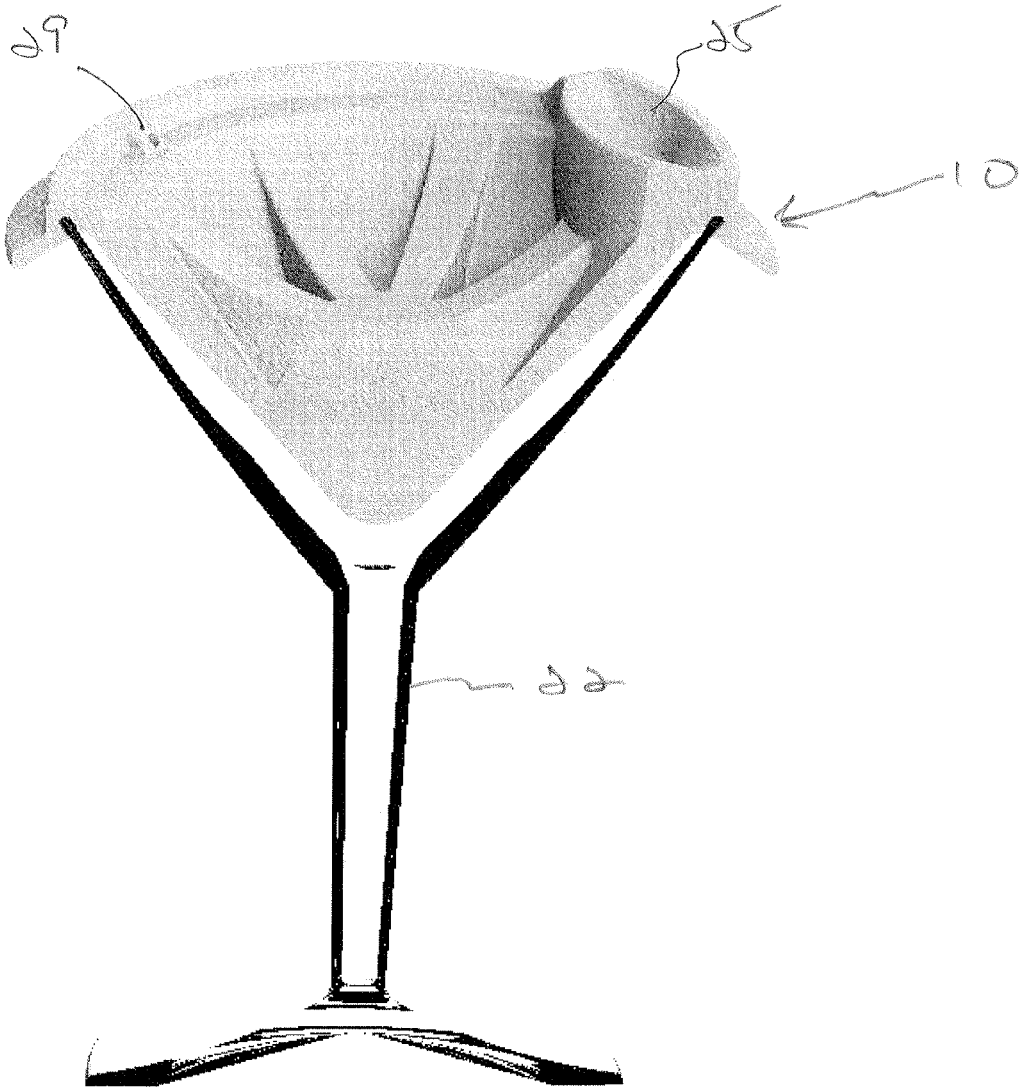
Figure 5:
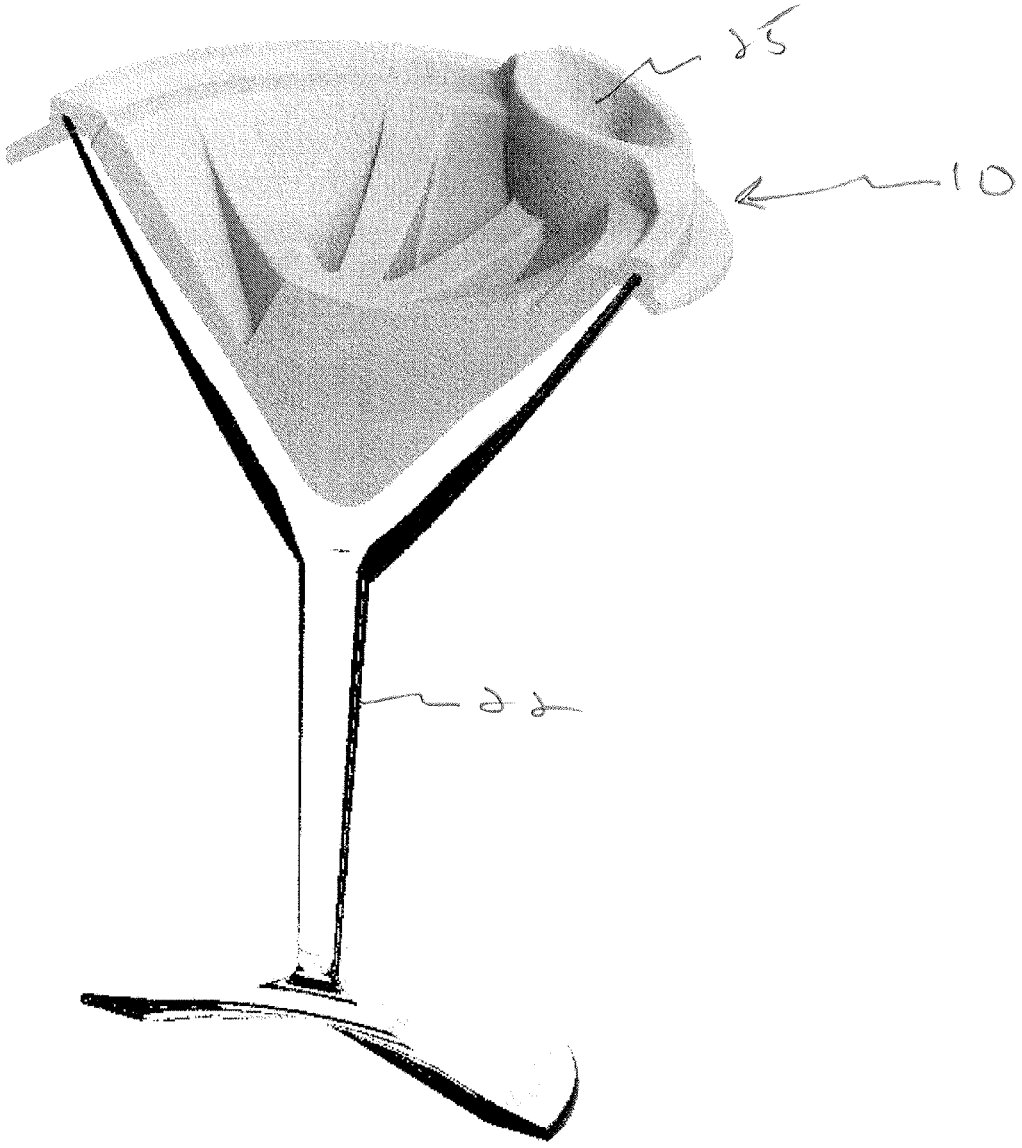

The ice mold 10 includes a body portion 12, FIG. 3, with an outer wall 14, which is shaped with a similar or identical angle and shape as the interior wall 30 of the drinking apparatus 22. The ice mold 10 includes a top surface 18, which is configured to cover the majority of the opening (not shown but well known and understood) formed by the upper rim 28 of the drinking apparatus 22.

When the ice mold 10 is placed into the drinking apparatus 22 a side wall void 24 is created, FIGS. 2-5. The side wall void 24 is created between the outer wall 14 of the ice mold 10 and the interior wall 30 of the drinking glass, cup or other drinking apparatus 22. In order to create an ice liner around the interior wall 30 of the drinking apparatus 22, a user first inserts the ice mold 10 onto the rim 28 of the drinking apparatus 22. In the preferred embodiment, the ice mold 10 includes a slot or groove 27 which is designed to friction fit on the rim 28 of the drinking apparatus 22. The friction fit slot or groove 28 serves to hold the ice mold 10 securely in place preventing it from "floating" up and also preventing it from moving from side to side in the glass when the liquid is added or the glass is moved, or as freezing occurs.

Next, the user simply pours water (or any other liquid that will freeze into shape around and against the interior wall 30 of the glass or cup 22 such as fruit juice for example) into the funnel shaped opening 25 of the ice mold 10. The funnel shaped opening 25 includes and opening 27 through the ice mold 10 which allows the liquid being poured in to enter the side wall void 24 located between the wall 14 of the ice mold 10 and the inner side wall 30 of the drinking apparatus 22. Any excess water or other liquid may be expelled from an exit hole 29 located in the top most region 18 of the ice mold, and fluidly connected with the void area 24 that exists between the ice mold 10 and the inner wall 30 of the drinking apparatus 22. The drinking glass or cup 22 with the ice mold 10 (and water or other liquid in place) is then placed in the freezer for an appropriately long period of time to freeze the liquid, following which the ice mold 10 is removed for use in another glass or cup 22 while the glass or cup 22 with the iceliner formed thereon to be left in the freezer for future use.

In one embodiment, the ice mold 10 may be formed from a generally solid and dense plastic or rubber-like material which, if not displaced by the water or liquid, may not require any means to hold it down in place (such as slot or groove 28) although spacing the ice mold 10 away from the interior walls of the glass of cup 22 will still be required. The ice mold 10 is preferably formed from a generally pliable food-grade silicone material that is flexible. Other materials are contemplated and within the scope of the present invention. The inner cavity 16 of the ice mold 10 may be created from a solid piece of material or preferably, in an effort to save on and minimize the amount of material utilized to manufacture the ice mold 10, the inner cavity 16 may feature a partially hollow or fully hollow inner cavity or may include several "ribs" 31 which serve to strengthen the ice mold 10.

The ice mold 10 includes a cover or lid 40. In this embodiment, the lid or cover 40 is designed as an extension or continuation of the material used for the body portion 12 of the ice mold 10. In this embodiment, the top surface 18 will extend out past the body portion 12 such that an outer rim 36 is formed on the ice mold 10 generally like a "cap" or "cover". The outer rim 36 is designed to sit directly on and perhaps frictionally engage with the upper rim 28 of the drinking cup or glass 22 by means of groove or slot 27. The outer rim 36 may removably couple to the upper rim 28. For example, the outer rim 36 may "snap" or "latch" onto the upper rim 28 of the drinking cup or glass 22 around an entire perimeter of the upper rim 28, such as the connection made between a lid attached to a plastic container. In this embodiment, the upper rim 28 of the drinking apparatus 22 may feature a flattened surface to accommodate the outer rim 36 of the ice mold 10. The cover or lid 40 includes a vent hole 29 as previously described.

The drinking apparatus 22 or the ice mold 10 may also feature a pre-indicated "fill line" (not shown) which indicates the correct amount of water to be added by a user prior once the ice mold 10 is inserted into the drinking glass or cup 22.

Figure 7:
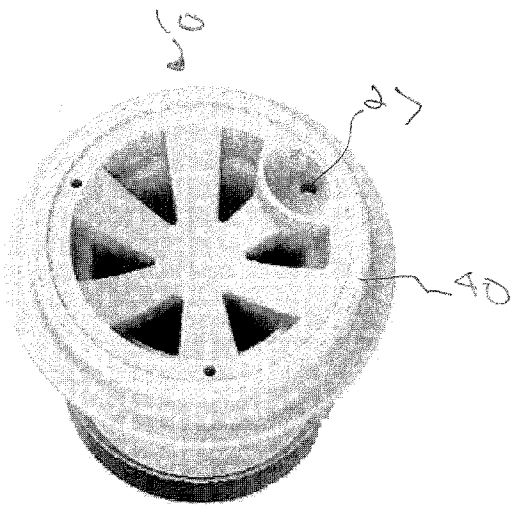
FIG. 7 is a top view of the ice forming apparatus of the present invention according to the second embodiment.
Figure 6:
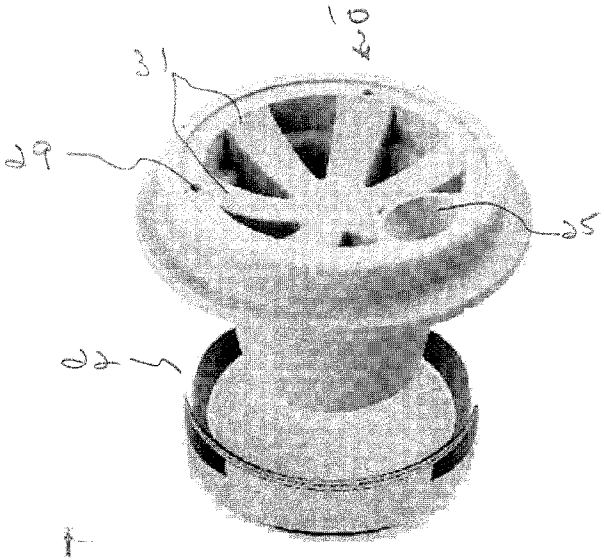
FIG. 6 is a perspective view of the ice forming apparatus according to a second embodiment of the present invention in use with a rocks glass.
Figure 8:
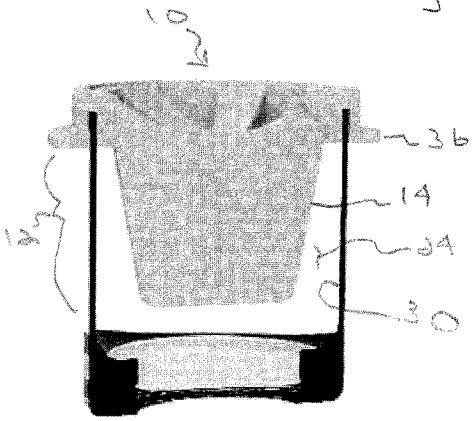
FIG. 8 is a cross-sectional views of the ice forming apparatus of FIG. 6 in accordance with the second embodiment of the present invention.

In a second embodiment shown in FIGS. 6-8, like parts are designated would like numbers. This embodiment shows how the ice mold 10 may be adjusted in size to fit a different type of glass while maintaining the same "features" and characteristics as described in connection with the ice mold inserted in a martini class shown and described in connection with FIGS. 1-5, all without the parting from the spirit of the present invention.

Accordingly, the present invention provides a novel ice mold which allows a thin layer of ice, juice or other liquid to be molded on to the inner surface of a drinking glass by placing the ice mold on a glass, filling a space between the ice mold and the inner wall of the drinking glass with fluid, placing the glass, fluid and ice mold in the freezer and once the fluid is frozen, removing the ice mold for reuse in another glass and for allowing the glass to be used to hold a drink while the ice servers to maintain the drink in a cold condition.

Modifications and substitutions by one of ordinary skill in the art are considered to be within the scope of the present invention, which is not to be limited except by the allowed claims and their legal equivalents.

The invention claimed is:

1. An ice mold for a drinking apparatus having an interior wall and a rim, said ice mold comprising:

a top region having no openings in fluid communication with a side wall void region located between said interior wall of said drinking apparatus and an exterior surface of an outer wall of a body portion of said ice mold;

a body portion, coupled to and extending from said top region, said body portion including an outer wall forming said exterior surface, said outer wall configured to correspond to a shape of at least a portion of said interior wall of said drinking apparatus and sized for forming said side wall void region located between said interior wall of said drinking apparatus and said exterior surface of said outer wall of said body portion;

an outer rim, coupled to and extending from said top region of said ice mold, said outer rim configured, in use, for abutting against said rim of said drinking apparatus wherein said outer rim includes a groove or slot configured for frictionally engaging with said rim of said drinking apparatus; and at least one opening in said outer rim, said at least one opening in fluid communication between said outer rim and said side wall void region in said drinking apparatus, and configured for allowing fluid to be inserted into said side wall void region through said opening in said outer rim.

2. The ice mold of claim 1 wherein said ice mold is manufactured from a soft, pliable food grade material.

3. The ice mold of claim 2 wherein said soft, pliable food grade material is silicone.

4. The ice mold of claim 1, wherein said at least one opening in said outer rim includes a fluid fill opening, said fluid fill opening in fluid communication between said outer rim and said side wall void region in said drinking apparatus, and configured for allowing fluid to be inserted into said side wall void region, wherein said at least one fluid fill opening is configured as a funnel type opening, and wherein said ice mold outer rim further includes a plurality of fluid exit holes spaced around a circumference of said outer rim and in fluid communication between said outer rim and said side wall void region in said drinking apparatus.

5. An ice mold for a drinking apparatus having an interior wall and a rim, said ice mold comprising:

a top region having no openings in fluid communication with a side wall void region located between said interior wall of said drinking apparatus and an exterior surface of an outer wall of a body portion of said ice mold;

a body portion coupled to and extending from said top region, said body portion including an outer wall forming said exterior surface, said outer wall configured to correspond to a shape of at least a portion of said interior wall of said drinking apparatus and sized for forming said side wall void region located between said interior wall of said drinking apparatus and said exterior surface of said outer wall of said body portion;

an outer rim, coupled to and extending from said top region of said ice mold, said outer rim configured, in use, for abutting against said rim of said drinking apparatus wherein said outer rim includes a groove or slot configured for frictionally engaging with said rim of said drinking apparatus, wherein said outer rim includes at least one fluid exit hole, said at least one fluid exit hole in fluid communication with a side wall void region that is formed between said ice mold and said interior wall of said drinking apparatus; and a fluid fill opening disposed in at least one of said top region, said body portion and said outer rim, said fluid fill opening in fluid communication between said outer rim and said side wall void region, and configured for allowing fluid to be inserted into said side wall void region, wherein said at least one fluid fill opening is configured as a funnel type opening, and wherein said outer rim includes a plurality of fluid exit holes spaced around a circumference of said outer rim, said plurality of fluid exit holes in fluid communication between said outer rim and said side wall void region in said drinking apparatus.

6. The ice mold of claim 5 wherein said ice mold is manufactured from a generally soft, pliable food grade material.

7. The ice mold of claim 6 wherein said soft, pliable food grade material is silicone.

8. The ice mold of claim 5 wherein the drinking apparatus is selected from the group of drinking apparatus consisting of a martini glass and a rocks glass.

9. An ice mold for a drinking apparatus having an interior wall and a rim, said ice mold comprising:

a top region having no openings in fluid communication with a side wall void region located between said interior wall of said drinking apparatus and an exterior surface of an outer wall of said body portion of said ice mold;

a body portion, coupled to and extending from said top region, said body portion including an outer wall forming said exterior surface, said outer wall configured to correspond to a shape of at least a portion of said interior wall of said drinking apparatus and sized for forming said side wall void region located between said interior wall of said drinking apparatus and said exterior surface of said outer wall of said body portion;

an outer rim, coupled to and extending from said top region of said ice mold, said outer rim configured, in use, for abutting against said rim of said drinking apparatus wherein said outer rim includes a groove or slot configured for frictionally engaging with said rim of said drinking apparatus; and a fluid fill opening disposed in said outer rim, said fluid fill opening in fluid communication between said outer rim and said side wall void region, and configured for allowing fluid to be inserted into said side wall void region, wherein said at least one fluid fill opening is configured as a funnel type opening.

* * * * *